US008836604B2

(12) United States Patent
Yang et al.

(10) Patent No.: US 8,836,604 B2
(45) Date of Patent: Sep. 16, 2014

(54) UNIFIED ANTENNA OF SHARK FIN TYPE

(75) Inventors: Tae Hoon Yang, Incheon (KR); Woo Jin Kim, Pyeongtaek-si (KR)

(73) Assignee: INFAC Elecs Co., Ltd., Incheon (KR)

( * ) Notice: Subject to any disclaimer, the term of this patent is extended or adjusted under 35 U.S.C. 154(b) by 117 days.

(21) Appl. No.: 13/351,024

(22) Filed: Jan. 16, 2012

(65) Prior Publication Data

US 2012/0188143 A1 Jul. 26, 2012

(30) Foreign Application Priority Data

Jan. 25, 2011 (KR) ..... 10-2011-0007420

(51) Int. Cl.
*H01Q 1/42* (2006.01)

(52) U.S. Cl.
USPC ..... 343/872

(58) Field of Classification Search
USPC ..... 343/872, 713; 455/143
See application file for complete search history.

(56) References Cited

U.S. PATENT DOCUMENTS

| | | | | |
|---|---|---|---|---|
| 8,081,126 | B2 * | 12/2011 | Ikeda et al. | 343/713 |
| 8,519,897 | B2 * | 8/2013 | Duzdar et al. | 343/713 |
| 2005/0219131 | A1 * | 10/2005 | Haidacher et al. | 343/725 |
| 2008/0198077 | A1 * | 8/2008 | Duzdar et al. | 343/715 |
| 2010/0013724 | A1 * | 1/2010 | Ohshima et al. | 343/713 |
| 2010/0136936 | A1 * | 6/2010 | Jiang | 455/143 |
| 2010/0277379 | A1 * | 11/2010 | Lindackers et al. | 343/713 |
| 2011/0221640 | A1 * | 9/2011 | Huber | 343/713 |

* cited by examiner

*Primary Examiner* — Huedung Mancuso
(74) *Attorney, Agent, or Firm* — IPLA P.A.; James E. Bame

(57) ABSTRACT

A unified antenna of shark fin type comprises a pad, a base disposed on upper surface of the pad and providing a space for arranging a printed circuit board and a plurality of antenna units, and a case for covering the pad and the base, wherein the antenna further comprises: a first antenna unit disposed in the middle of the printed circuit board and provided for receiving signal of AM/FM band; a second antenna unit disposed near the first antenna unit and provided for receiving signal of DMB (Digital Multimedia Broadcasting) band; and a third antenna unit disposed in front of the first antenna unit and provided for receiving signal of GPS (Global Positioning System) band, and a first auxiliary unit is disposed over the first antenna unit for enhancing electrical properties of the first antenna unit.

4 Claims, 6 Drawing Sheets

UNIFIED ANTENNA OF SHARK FIN TYPE

CROSS REFERENCE

This application claims foreign priority under Paris Convention to Korean Patent Application No. 10-2011-0007420, filed Jan. 25, 2011 with the Korean Intellectual Property Office, where the entire contents are incorporated herein in its entirety.

BACKGROUND OF THE INVENTION

1. Field of the Invention

The present invention relates to a unified antenna of shark fin type, more specifically, a unified antenna of shark fin type which can be made relatively small and at the same time has good gain and radiation pattern conditions of antenna, thereby smoothly receiving signals of various bands, by disposing the auxiliary units contacting with the antenna units within the range of space available inside the shark fin-type antenna.

2. Background of the Invention

Generally used in a vehicle is a pole-type antenna for allowing a radio in the vehicle to receive signals.

In this regard, a conventional helical antenna is an antenna having a spiral coil structure such that resonance may be generated at antenna length($\lambda/4$), and such a helical antenna exhibits a resonance at a specific frequency according to the length and pitch of the antenna.

However, the helical antenna is difficult to exhibit a resonance at another resonance frequency desired by users as the resonance is generated at a specific frequency of single band.

That is to say, in the case of the conventional helical antenna, primary resonance is possible, but secondary resonance is difficult to be generated at a desired frequency, and thus there is a problem that two frequencies cannot be selected.

Furthermore, there are problems that tuning is difficult, large error is generated, the return value of resonance frequency is subject to much losses, and in injecting the coil by means of a insert injection method, a state of the tuning is changed, and therefore a desired resonance frequency is not provided.

Meanwhile, recently, as various services such as mobile communication are commercialized, such new electronic products are developed, and equipped in vehicle are devices to which corresponding mobile communication technologies are applied.

In addition, in order to satisfy various desires of consumers, electronic devices for new application such as internet, TV signal reception, navigation system, DMB (Digital Multimedia Broadcasting) etc. for use in vehicle are developed.

That is to say, only function of vehicle is to simply provide the consumer with transportability, but the function has been extended recently to a concept of providing of safe, convenient and efficient transportation means.

Therefore, antenna system for vehicle for new application is required for various wireless services provided in vehicle such as internet, TV signal reception, navigation system, DMB etc. for use in vehicle, and the actual circumstance is that the antenna system gradually become more complex and is diversified due to the development of information and communication technology.

By the way, in the case of a conventional antenna system for vehicle, signal-receiving antennas for various wireless services are separately constructed for respective wireless service.

However, installing of a separate antenna for respective wireless service, as mentioned above, exhibits fundamental problems such as limitation of installation in a restricted space of vehicle and increase of installation cost etc.

SUMMARY OF THE INVENTION

The present invention has been devised for solving the above-mentioned problems, and its object is to provide a unified antenna of shark fin type which can be made relatively small and at the same time has good gain and radiation pattern conditions of antenna, thereby smoothly receiving signals of various bands, by disposing the auxiliary units contacting with the antenna units within the range of space available inside the shark fin-type antenna.

Another object of the present invention is to provide a unified antenna of shark fin type which can be flexibly adapted to receive signal of different band according to areas where the antenna is used by providing a helical structure, a patch structure, a ceramic structure, a dipole structure and a board structure with pattern formed thereon for antenna structure, variously assembling them and at the same time providing antenna units and auxiliary units of various shapes.

Yet another object of the present invention is to provide a unified antenna of shark fin type which has a simple internal structure and compact construction and thus can increase mass-productivity of product.

The above-mentioned objects of the present invention are achieved according to the present invention by a unified antenna of shark fin type comprising a pad, a base disposed on upper surface of the pad and providing a space for arranging a printed circuit board and a plurality of antenna units, and a case for covering the pad and the base, wherein the antenna further comprises a first antenna unit disposed in the middle of the printed circuit board and provided for receiving signal of AM/FM band; a second antenna unit disposed near the first antenna unit and provided for receiving signal of DMB (Digital Multimedia Broadcasting) band; and a third antenna unit disposed in front of the first antenna unit and provided for receiving signal of GPS (Global Positioning System) band, and a first auxiliary unit is disposed over the first antenna unit for enhancing electrical properties of the first antenna unit.

Here, the first auxiliary unit contacts at a portion thereof with the first antenna unit, and has a shape corresponding to inner surface of the case, and is made of copper plate or aluminum material. and formed by preparing a circular or polygonal flat blank and bending the blank into the shape corresponding to the inner surface of the case.

Furthermore, the first antenna unit has a helical antenna structure that comprises a mount and a coil wound along outer surface of the mount, and the mount is made of any one of POM (Poly Oxy Methylene), Poly Acetal, ABS (Acrylonitrile Butadiene Styrene) resin and PC (Poly Carbonate), and the height and width of the mount is different depending on the material for the mount, and the coil may be made of any one of copper and SUS(Steel Use Stainless).

Here, the second antenna unit is made of glass epoxy board with antenna pattern formed thereon, and then disposed upright on the printed circuit board near the first antenna unit, and the second antenna unit is adapted to receive TDMB (Terrestrial Digital Multimedia Broadcasting) and HSDPA signals or DAB Ⅲ (Digital Audio Broadcasting Band Ⅲ) and DAB-L signals or GSM signal, and a second auxiliary unit is disposed over the second antenna unit for enhancing the electrical properties of the second antenna unit, and the second auxiliary unit contacts at a portion thereof with the second antenna unit, and has a shape corresponding to the inner surface of the case, and the second auxiliary unit is made of copper plate or aluminum material. and is formed by preparing a circular or polygonal flat blank and bending the blank into the shape corresponding to the inner surface of the case.

Meanwhile, the third antenna unit is provided as a patch or ceramic antenna arranged on the printed circuit board, and is provided in the plural number for receiving the GPS signal and the XM and SIRIUS satellite radio signals.

According to the present invention, the unified antenna of shark fin type can be made relatively small and at the same time has good gain and radiation pattern conditions of antenna, thereby smoothly receiving signals of various bands, by disposing the auxiliary units contacting with the antenna units within the range of space available inside the shark fin-type antenna.

Furthermore, the unified antenna of shark fin type according the present invention can be flexibly adapted to receive signal of different band according to areas where the antenna is used by providing a helical structure, a patch structure, a ceramic structure, a dipole structure and a board structure with pattern formed thereon for antenna structure, variously assembling them and at the same time providing antenna units and auxiliary units of various shapes In addition, the unified antenna of shark fin type according the present invention has a simple internal structure and compact construction and thus can increase mass-productivity of product

BRIEF DESCRIPTION OF THE DRAWING

The attached drawings have a purpose of facilitating the understanding of the technical concepts of the present invention along with the above detailed description of the invention, and thus the present invention should not be interpreted as being limited to the matters illustrated in the attached drawings.

Figure 1:
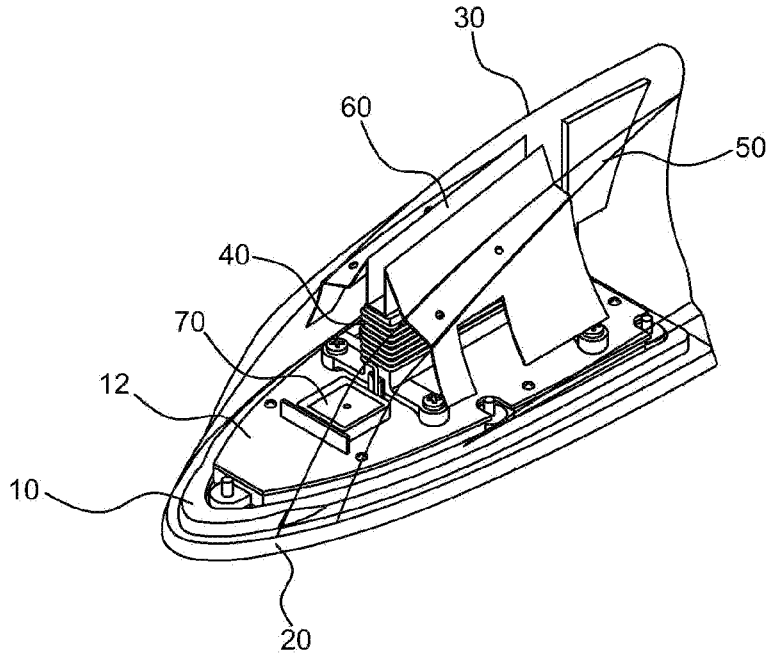
FIG. 1 is a perspective view illustrating a unified antenna of shark fin type according to the present invention in an assembled state.

| LISTS OF REFERNECE NUMERALS IN THE DRAWINGS * | |
|---|---|
| 10: base | 12: printed circuit board |
| 20: pad | 30: case |
| 40: first antenna unit | 50: second antenna unit |
| 52: second auxiliary unit | 60: first auxiliary unit |
| 70: third antenna unit | |

DETAILED DESCRIPTION OF EXEMPLARY EMBODIMENTS

Hereinafter, constructions of the present invention will be described in detail with reference to the attached drawings.

Prior to description, it should be noted that terms used in the specification and claims should not be limitedly interpreted as lexical meanings, but should be interpreted as meanings and concepts coinciding to technical concepts of the present invention based on the principle that inventors may properly define the concepts of the terms in order to explain their inventions in a best way.

Therefore, examples described in the specification and constructions illustrated in the drawings are only preferred examples of the present invention, and do not represent all of the technical concepts of the present invention, and thus it should be understood that various equalities and modifications may be present which can replace them at the time of application of the present invention.

Figure 2:
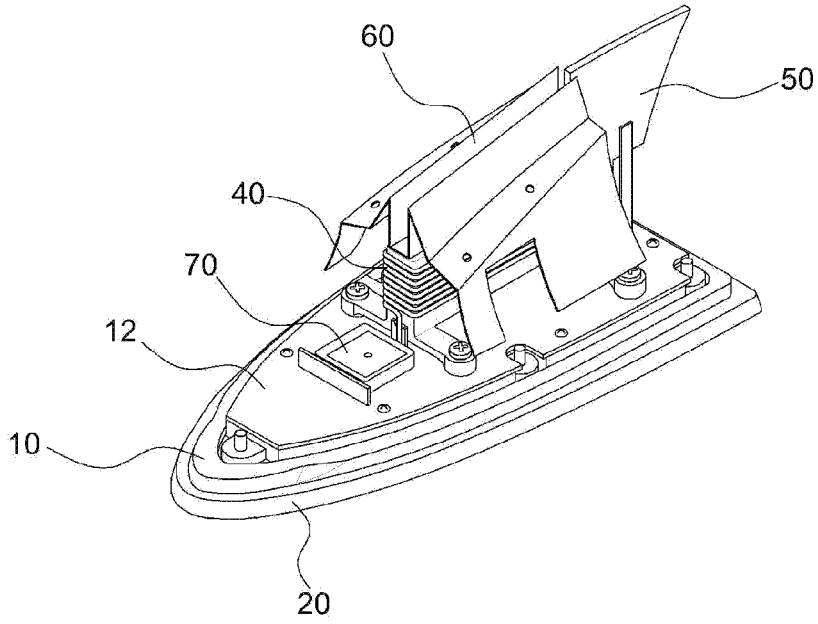
FIG. 2 is a perspective view illustrating an internal construction of the unified antenna of shark fin type according to a first example of the present invention.
Figure 3:
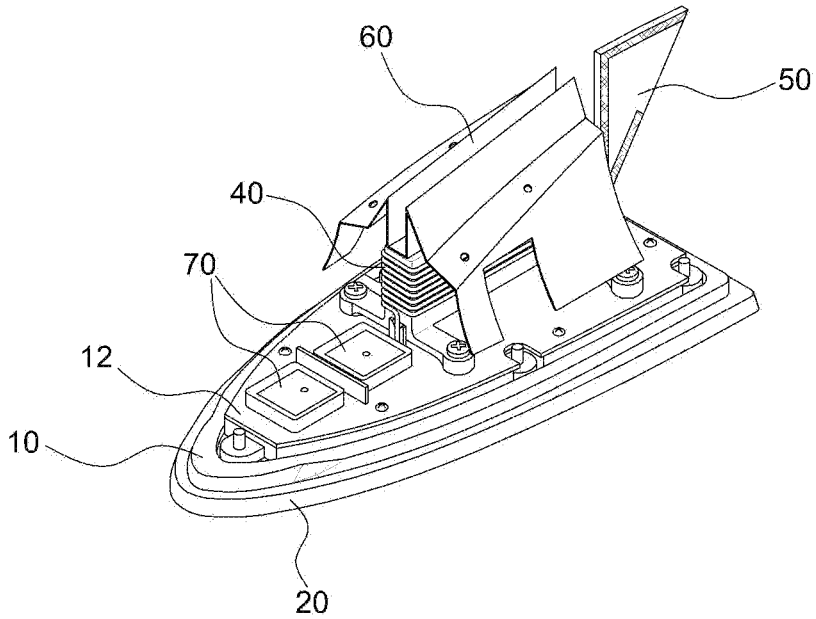
FIG. 3 is a perspective view illustrating an internal construction of the unified antenna of shark fin type according to a second example of the present invention.
Figure 4:
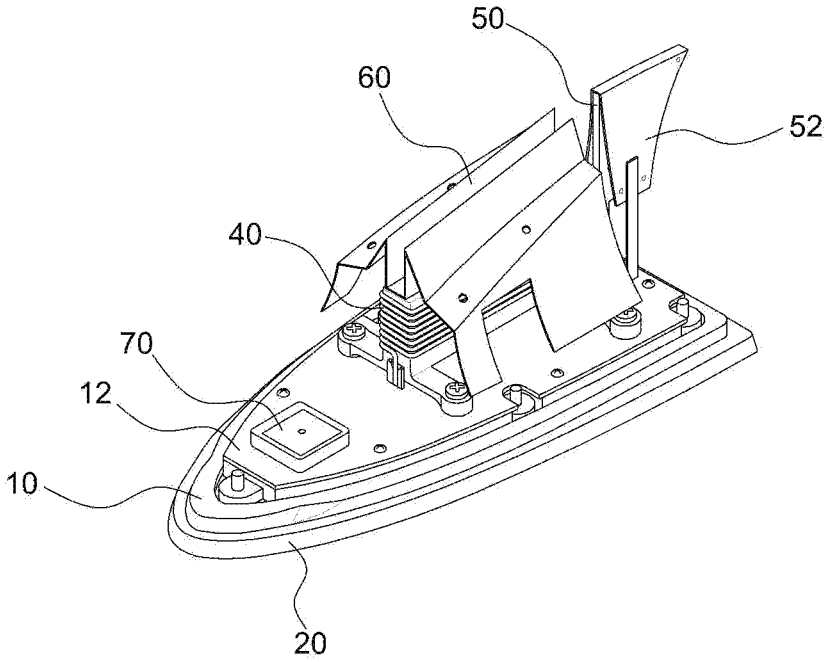
FIG. 4 is a perspective view illustrating an internal construction of the unified antenna of shark fin type according to a third example of the present invention.
Figure 5:
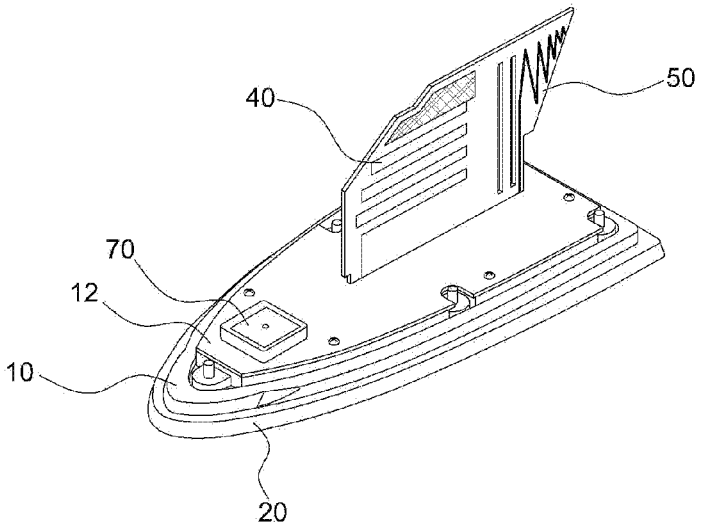
FIG. 5. is a perspective view illustrating an internal construction of the unified antenna of shark fin type according to a fourth example of the present invention.

FIG. 1 is a perspective view illustrating a unified antenna of shark fin type according to the present invention in an assembled state, FIG. 2 is a perspective view illustrating an internal construction of the unified antenna of shark fin type according to a first example of the present invention, FIG. 3 is a perspective view illustrating an internal construction of the unified antenna of shark fin type according to a second example of the present invention, FIG. 4. is a perspective view illustrating an internal construction of the unified antenna of shark fin type according to a third example of the present invention, and FIG. 5. is a perspective view illustrating an internal construction of the unified antenna of shark fin type according to a fourth example of the present invention.

Referring to FIGS. 1 to 5, the unified antenna of shark fin type according to the present invention is a unified antenna of shark fin type comprising a pad (20), a base (10) disposed on upper surface of the pad (20) and providing a space for mounting a printed circuit board (12) and a plurality of antenna units, and a case (30) for covering the pad (20) and the base (10), and comprises a first antenna unit (40) disposed in the middle of the printed circuit board (12) and provided for receiving signal of AM/FM band; a second antenna unit (50) disposed near the first antenna unit (40) and provided for receiving signal of DMB (Digital Multimedia Broadcasting) band; and a third antenna unit (70) disposed in front of the first antenna unit (40) and provided for receiving signal of GPS (Global Positioning System) band, and a first auxiliary unit (60) is disposed over the first antenna unit(40) for enhancing electrical properties of the first antenna unit (40).

Here, the unified antenna of shark fin type according to the present invention may have a shape looking like a dorsal fin of a shark, as shown in FIG. 1, and may have a length of about 160 mm, a height of about 68 mm and a width of about 80 mm.

Here, the first antenna unit (40) is a component for receiving the signal of AM/FM frequency band, and may have a helical antenna structure that comprises a mount and a coil wound along outer surface of the mount, as shown FIGS. 1 to 4.

Here, the mount is fixed to the base (10) by means of bolts, and the coil is wound with several turns to several tens turns along a body of the mount to receive the signal of AM/FM band.

Furthermore, the mount may be made of synthetic resin material having a permittivity no less than a certain value, and preferably may be made of any one of POM (Poly Oxy Methylene), Poly Acetal, ABS (Acrylonitrile Butadiene Styrene) resin and PC (PolyCarbonate).

Here, since the mount has a different permittivity depending on the material which it is made of, the height and width of the mount may be different depending on the material, and according to the construction of such a mount, properties of the first antenna unit (40), i.e., gain and band width of the antenna may be varied.

Furthermore, the coil may be made of a variety of metal material through which electrical signal can be transmitted, and preferably may be made of any one of copper and SUS (Steel Use Stainless).

Meanwhile, the first antenna (40) may be made of glass epoxy board with antenna pattern formed thereon, and then disposed upright on the printed circuit board (12), as shown in FIG. 5.

In this case, the glass epoxy board and antenna pattern serve to receive the signal of AM/FM band, and performance of signal receiving rate is determined by the length of antenna pattern formed on the glass epoxy board.

Furthermore, the first antenna unit (40) may receive the signal of AM/FM band with a construction where two glass epoxy boards forming the first antenna unit are spaced from each other with a preset distance.

Meanwhile, the auxiliary unit (60) may be disposed over the first antenna unit (40) for enhancing the electrical properties of the first antenna unit (40).

Here, the first auxiliary unit (60) is a component for enhancing signal reception performance of the first antenna unit (40) by contacting with the first antenna unit (40), and serves to extend the length of the first antenna unit (40) such that the first antenna unit (40) can resonate at a length of $\lambda/4$, whereby the electrical properties of the first antenna unit (40) (for example, gain, directivity and band width) can be enhanced.

Here, the first auxiliary unit (60) contacts at a portion thereof with the first antenna unit (40), and may have a shape corresponding to inner surface of the case (30), as shown in FIGS. 1 to 5.

It has the purpose of enhancing the signal reception performance of the first antenna unit (40) by increasing surface area of the first auxiliary unit (60) within the range of space available inside the antenna, and the first auxiliary unit can enhance the electrical properties of the first antenna unit (40) by having a shape corresponding to the inner surface of the case (30), as shown in FIGS. 1 to 5.

Furthermore, the first auxiliary unit (60) may be fixed to the inner surface of the case (30) by means of heat fusion process for increasing mass-productivity of product assembly, and may be made of copper plate or aluminum material.

Furthermore, the first auxiliary unit (60) may be formed by preparing a circular or polygonal flat blank and bending the blank into the shape corresponding to the inner surface of the case (30), and then fixed to the inner surface of the case (30).

Here, the first auxiliary unit (60) may have various shapes, as shown in FIGS. 1 to 5.

Here, as shown in FIGS. 1 to 4, since the first antenna unit (40) is in the form of a helical antenna that consists of the mount and the coil wound on the mount, the first auxiliary unit (60) is approximately triangular with a middle portion thereof depressed, as seen from the front, for contacting with the first antenna unit (40).

Alternatively, as shown in FIG. 5, since the first antenna unit (40) is in the form of a board-type antenna that consists of the glass epoxy board and the antenna pattern formed thereon, the first auxiliary unit (60) may be triangular as a whole, as seen from the front, for contacting with upper portion of the first antenna unit (40).

Here, the structure and shape of the first auxiliary unit (60) is not limited to those illustrated in FIGS. 1 to 4, and naturally, the shape of the first auxiliary unit may be varied within a range of shape allowing it to be fixed along the inner surface of the case (30) according to required signal reception band and performance.

Meanwhile, the second antenna unit (50) is a component for receiving the signal of DMB (Digital Multimedia Broadcasting) band, and may be made of the glass epoxy board with the antenna pattern formed thereon and then disposed upright on the printed circuit board (12) near the first antenna unit (40), as shown in FIGS. 1 to 5.

Here, the second antenna unit (50) may be adapted to receive TDMB (Terrestrial Digital Multimedia Broadcasting) and HSDPA signals or DABⅢ (Digital Audio Broadcasting Band Ⅲ) and DAB-L signals or GSM signal(GSM850/1900) according to areas where the unified antenna of shark fin type according to the present invention is used.

That is to say, the unified antenna of shark fin type according to the present invention may be classified into a type for use in Korea, a type for use in North America and a type for use in Europe, and since frequency band is different according to communication protocol for respective nations, the antenna should be produced so as to conform to the communication protocol adopted by respective nations.

That is to say, the shape and structure of the second antenna unit (50) should be different depending on the nation where the antenna is used; for example, in the case of the unified antenna of shark fin type for use in Korea, the second antenna unit (50) may be formed in a shape such as shown in FIG. 2 to receive TDMB (Terrestrial Digital Multimedia Broadcasting) and HSDPA signals.

Furthermore, in the case of the unified antenna of shark fin type for use in North America, the second antenna unit (50) is formed in a shape such as shown in FIG. 3 to receive GSM signal.

Furthermore, in the case of the unified antenna of shark fin type for use in Europe, the second antenna unit (50) is formed in a shape such as shown in FIG. 4 to receive DABⅢ (Digital Audio Broadcasting Band Ⅲ) and DAB-L signals.

Meanwhile, disposed over the second antenna unit (50) may be a second auxiliary unit (52) for enhancing the electrical properties of the second antenna unit (50), as shown in FIG. 4.

Here, the second auxiliary unit (52) is a component for enhancing the signal reception performance of the second antenna unit (50) by contacting with the second antenna unit (50), and serves to extend the length of the second antenna unit (50) such that the second antenna unit (50) can resonate at a length of $\lambda/4$, whereby the electrical properties of the second antenna unit (50) (for example, gain, directivity and band width) can be enhanced.

Here, the second auxiliary unit (52) contacts at a portion thereof with the second antenna unit (50), and may have a shape corresponding to the inner surface of the case (30), as shown in FIG. 4.

It has the purpose of enhancing the signal reception performance of the second antenna unit (50) by increasing surface area of the second auxiliary unit (52) within the range of space available inside the antenna, and the second auxiliary unit can enhance the electrical properties of the second antenna unit (50) by having a shape corresponding to the inner surface of the case (30).

Furthermore, the second auxiliary unit (52) may be fixed to the inner surface of the case (30) by means of the heat fusion process for increasing mass-productivity of product assembly, and may be made of copper plate or aluminum material.

Furthermore, the second auxiliary unit (52) may be formed by preparing a circular or polygonal flat blank and bending the blank into a shape corresponding to the inner surface of the case (30), and then fixed to the inner surface of the case (30).

Here, the structure and shape of the second auxiliary unit (52) is not limited to that illustrated in FIG. 4, and naturally, the shape of the second auxiliary unit may be varied within a range of shape allowing it to be fixed along the inner surface of the case (30) according to the required signal reception band and performance.

Meanwhile, the third antenna unit (70) is a component for receiving signal of GPS (Global Positioning System) band, and provided as a patch or ceramic antenna arranged on the printed circuit board (12), as shown in FIGS. 1 to 5.

Furthermore, the third antenna unit (70) may be provided in the plural number, as shown in FIG. 3, and in this case, the third antenna unit (70) may be disposed while being distinguished by a unit for receiving the GPS signal and a unit for receiving the XM and SIRIUS satellite radio signal.

In the following, referring to FIGS. 6 and 7, gains and radiation characteristics for bands for the unified antenna of shark fin type according to the present invention, and conventional standard antenna and micro antenna will be described by comparison thereof.

Figure 6:
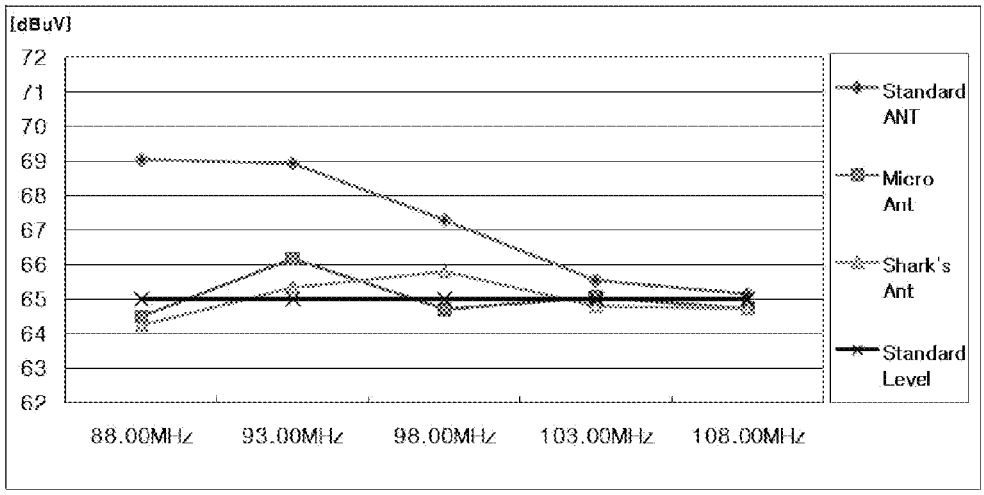
FIG. 6 is a graph measuring and comparing gains of the unified antenna of shark fin type according to the present invention, the standard antenna and micro antenna.
Figure 7A:
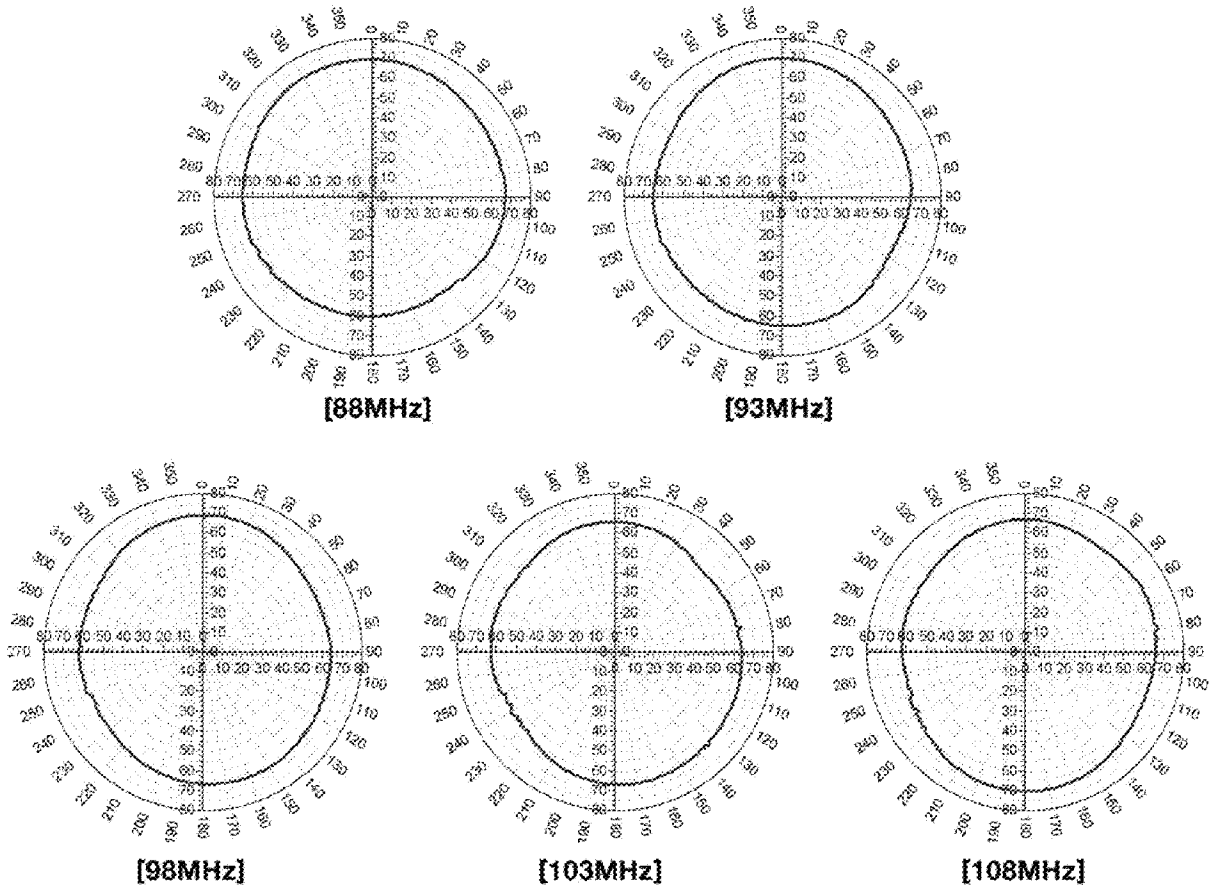
FIGS. 7*a*-7*c* are graphs measuring radiation characteristics for bands and gains for the standard antenna (FIG. 7*a*), the micro antenna (FIG. 7*b*) and the unified antenna of shark fin type of the present invention (FIG. 7*c*).
Figure 7B:
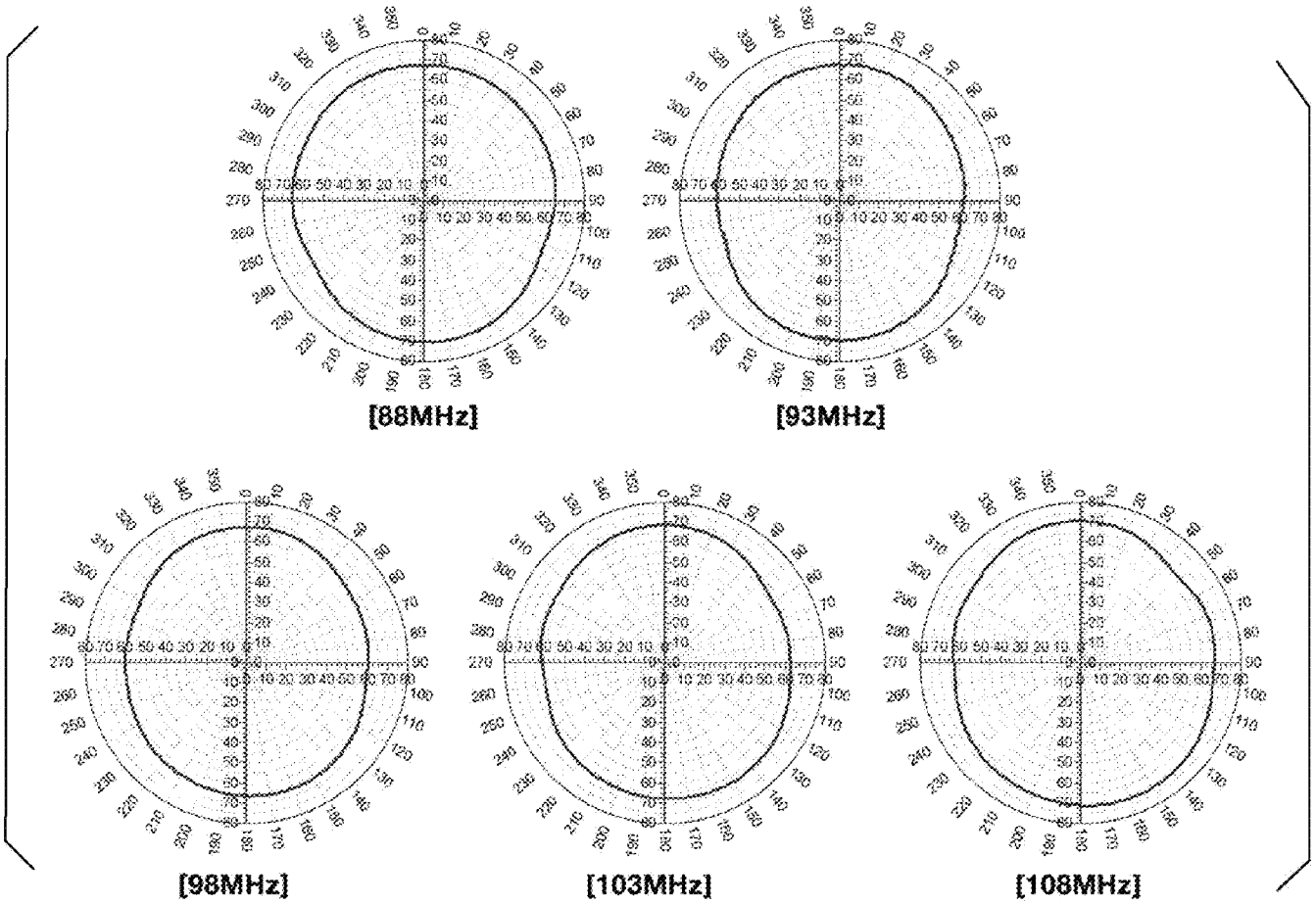
Figure 7C:
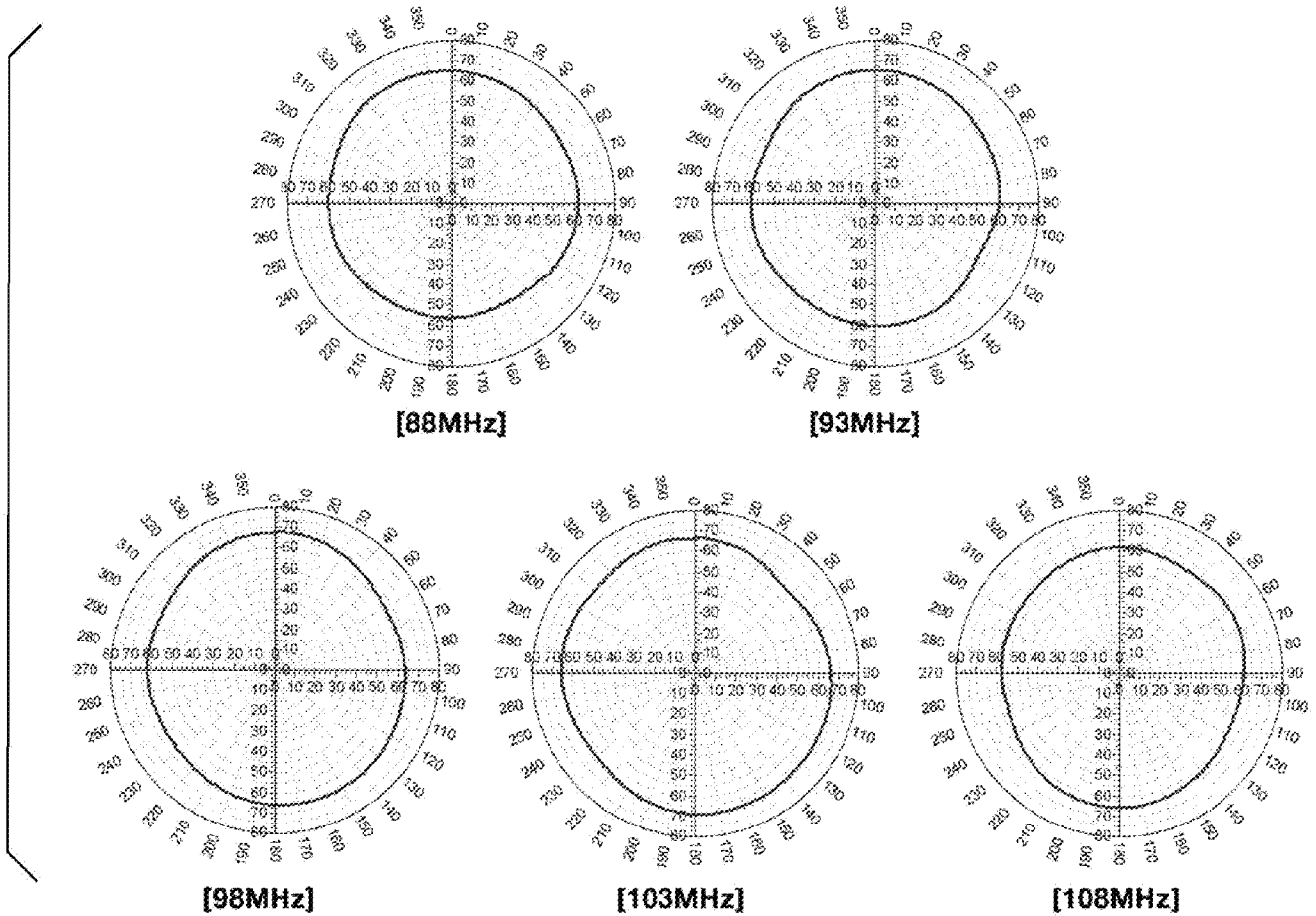

FIG. 6 is a graph measuring and comparing gains of the unified antenna of shark fin type according to the present invention, the standard antenna and micro antenna, and (a), (b) and (c) of FIG. 7 are graphs measuring radiation characteristics for bands and gains for the standard antenna {(a)}, the micro antenna {(b)} and the unified antenna of shark fin type of the present invention {(c)}.

As can be seen from FIG. 6, if comparing the standard antenna having a length of 750 mm with the unified antenna of shark fin type according to the present invention, the standard antenna exhibits a high performance over the whole band, but almost similar performance over band after 98 MHz, and if comparing the micro antenna having a length of 180 mm with the unified antenna of shark fin type according to the present invention, the unified antenna of shark fin type exhibits a good or equal performance over the whole band.

Furthermore, as can be seen from FIG. 7, the radiation characteristics of the standard antenna having a length of 750 mm, the micro antenna having a length of 180 mm and the unified antenna of shark fin type according to the present invention exhibit almost similar values over the whole range from 88 MHz to 108 MHz, and the unified antenna of shark fin type is relatively small and yet exhibits equal or similar performance when compared to the relatively large standard antenna and micro antenna.

As described above, the unified antenna of shark fin type according to the present invention can be made relatively small and at the same time has good gain and radiation pattern conditions of antenna, thereby smoothly receiving signals of various bands, by disposing the auxiliary units contacting with the antenna units within the range of space available inside the shark fin-type antenna.

Furthermore, the unified antenna of shark fin type according the present invention can be flexibly adapted to receive signal of different band according to areas where the antenna is used by providing a helical structure, a patch structure, a ceramic structure, a dipole structure and a board structure with pattern formed thereon for antenna structure, variously assembling them and at the same time providing antenna units and auxiliary units of various shapes, and has a simple internal structure and compact construction and thus can increase mass-productivity of product As mentioned above, though the present invention has been described with the specific examples and drawings, its technical concepts are not limited to them, and therefore the persons having ordinary skills in the art may carry out the present invention in other way by various modifications and alterations thereof without departing from the technical concepts of the present invention and equalities of the following claims.

What is claimed:

1. A unified antenna of shark fin type comprising a pad, a base disposed on upper surface of the pad and providing a space for arranging a printed circuit board and a plurality of antenna units, and a case for covering the pad and the base, wherein the antenna further comprises:

a first antenna unit disposed in the middle of the printed circuit board and provided for receiving signal of AM/FM band;

a second antenna unit disposed near the first antenna unit and provided for receiving signal of DMB (Digital Multimedia Broadcasting) band; and a third antenna unit disposed in front of the first antenna unit and provided for receiving signal of GPS (Global Positioning System) band, and a first auxiliary unit is disposed over the first antenna unit for enhancing electrical properties of the first antenna unit, wherein the second antenna unit is made of glass epoxy board with antenna pattern formed thereon, and then disposed upright on the printed circuit board near the first antenna unit, and the second antenna unit is adapted to receive TDMB (Terrestrial Digital Multimedia Broadcasting) and HSDPA signals or DABIII (Digital Audio Broadcasting Band III) and DAB-L signals or GSM signal, and a second auxiliary unit is disposed over the second antenna unit for enhancing the electrical properties of the second antenna unit, and the second auxiliary unit contacts at a portion thereof with the second antenna unit, and has a shape corresponding to the inner surface of the case, and the second auxiliary unit is made of copper plate or aluminum material and is formed by preparing a circular or polygonal flat blank and bending the blank into the shape corresponding to the inner surface of the case.

2. The unified antenna of shark fin type according to claim 1, wherein the first auxiliary unit contacts at a portion thereof with the first antenna unit, and has a shape corresponding to inner surface of the case, and the first auxiliary unit is made of copper plate or aluminum material, and formed by preparing a circular or polygonal flat blank and bending the blank into the shape corresponding to the inner surface of the case.

3. The unified antenna of shark fin type according to claim 1, wherein the first antenna unit has a helical antenna structure that comprises a mount and a coil wound along outer surface of the mount, and the mount is made of any one of POM (Poly Oxy Methylene), Poly Acetal, ABS (Acrylonitrile Butadiene Styrene) resin and PC (Poly Carbonate), and the height and width of the mount is different depending on the material for the mount, and the coil is made of any one of copper and SUS (Steel Use Stainless).

4. The unified antenna of shark fin type according to claim 1, wherein the third antenna unit is provided as a patch or ceramic antenna arranged on the printed circuit board, and is provided in the plural number for receiving the GPS signal and the XM and SIRIUS satellite radio signals.

* * * * *